US005959589A

United States Patent [19]

Sadovnik et al.

[11] Patent Number: 5,959,589

[45] Date of Patent: Sep. 28, 1999

[54] REMOTE FIRE DETECTION METHOD AND IMPLEMENTATION THEREOF

[75] Inventors: Lev S. Sadovnik, Irvine; Vladimir A. Manasson, Los Angeles; Robert E. Chapman, Solana Beach, all of Calif.

[73] Assignee: WaveBand Corporation, Torrance, Calif.

[21] Appl. No.: 08/887,472

[22] Filed: Jul. 2, 1997

[51] Int. Cl.[6] ..... H01Q 3/00

[52] U.S. Cl. ..... 343/765; 343/785; 343/757

[58] Field of Search ..... 343/785, 765, 343/763, 757, 758; H01Q 3/00

[56] References Cited

U.S. PATENT DOCUMENTS

| | | | |
|---|---|---|---|
| 4,181,283 | 1/1980 | Rizzo | 343/765 |
| 5,014,069 | 5/1991 | Seiler et al. | 343/785 |
| 5,015,052 | 5/1991 | Ridgway et al. | 350/96.13 |
| 5,305,123 | 4/1994 | Sadovnik et al. | 359/4 |
| 5,572,228 | 11/1996 | Manasson et al. | 343/785 |
| 5,815,124 | 9/1998 | Manasson et al. | 343/785 |

FOREIGN PATENT DOCUMENTS

WO 87/01243 2/1987 WIPO .

OTHER PUBLICATIONS

"Radiation Characteristics of a Dielectric Slab Waveguide Periodically Loaded with Thick Metal Strips," Matsumoto et al., *IEEE Transactions on Microwave Theory and Techniques*, vol. MTT–35, No. 2, Feb. 1987, pp. 89–95.

"A Practical Theory For Dielectric Image Guide Leaky–Wave Antennas Loaded By Periodic Metal Strips," Guglielmi et al., *Polytechnic University*, Booklyn New York, U.S.A., pp. 549–554.

"Antenna Technology for Millimeter–Wave Applications in Automobiles," Jain, Hughes.

"MM–wave RADAR for Advanced Intelligent Cruise Control Applications," Tribe et al., John Langley Lucas Industries, plc, UK, pp. 9, 10 (M1.1) & 18 (M1.4).

"Millimeter–Wave Beam Steering Using 'Diffraction Electronics,'" Seiler et al., *IEEE Transactions on Antennas and Propagation*, vol. AP–32, No. 9, Sep. 1984, pp. 987–990.

WFFB "Millimeter–Wave Technology Application in Automobiles," *1994 IEEE MTT–S International Microwave Symposium*, May 23–27, 1994, San Diego, CA, Workshop Notes.

An Automotive Collision Avoidance and Obstacle Detection Radar BATTELLE, Columbus Div. May 1, 1986, pp. 1–14.

Millimeter–Wave Beam Steering Using "Diffraction Electronics", M. Seiler & B. Mathena, IEEE Transactions on Antennas and Propagation, vol. AP–32, No. 9, Sep. 1984.

Russian Publication 1978. Tom 240, No. 6, pp. 1340–1343, Andrenko et al.

Russian Publication 1979. Tom 247, No. 1, pp. 73–76, Andrenko et al.

*Primary Examiner*—Hoanganh Le
*Attorney, Agent, or Firm*—Nilles & Nilles, S.C.

[57] ABSTRACT

Systems and methods for thermal imagining are described. An apparatus includes a rotatable radial scanning antenna. The systems and methods provide advantages in that fires can be detected, and their positions determined, over substantial distances and through obscurants such as smoke and/or rain.

20 Claims, 9 Drawing Sheets

REMOTE FIRE DETECTION METHOD AND IMPLEMENTATION THEREOF

BACKGROUND OF THE INVENTION

1. Field of the Invention

The present invention relates generally to the field of thermal imaging. More particularly, the implementation of the present invention relates to systems that include a scanning antenna for thermal imaging. Specifically, a preferred implementation of the present invention relates to a system that includes a rotatable millimeter wavelength (MMW) radial scanning antenna for fire detection within a perimeter area. The present invention thus relates to fire detection systems of the type that can be termed scanning thermal imaging.

2. Discussion of the Related Art

Historically, interior fire sensors have been based on smoke detectors. In some instances, these smoke detectors have been supplemented with an infrared (IR) heat detector in a combined fire sensor system. However, both smoke detectors and infrared heat detectors are not readily applicable to outdoor fire detection, which requires remote sensing over relatively large areas.

In the past, various kinds of optical sensors have also been used for the purpose of interior fire detection. The two wavebands generally used by such optical sensors are the infrared waveband and the ultraviolet (UV) waveband. Both of these wavebands have advantages and disadvantages. Systems that operate in the ultraviolet band have fast response times, but are subject to false alarms. Systems that operate in the infrared band have fewer false alarms, but have slow response times. Often these two bands are used together in one combined fire detection system so that the negative aspects of one band are compensated for by the positive aspects of the other band.

More recently, commercial optical sensors for fire detection have used multiple infrared wavelengths. Referring to FIG. 1, the typical emission spectrum from a typical hydrocarbon fire is high in infrared content. Using multiple infrared bands (e.g., 2.7 $\mu$m and 4.3 $\mu$m) improves detectability and reduces false alarms. The 4.3 $\mu$m infrared band takes advantage of the distinctive $CO_2$ emissions created by most fires. In addition, a shorter wavelength is often also selected (e.g., 0.2 $\mu$m). This shorter wavelength is generally used to look for "flicker" (i.e., fast nonperiodic signals) and to provide a basis for comparison with the infrared bands. In operation, signal strength ratios are taken between the bands and, when predetermined criteria are met, an alarm is actuated. Flicker is an important discriminant because fire is one of the very few blackbody radiators that exhibits flicker. However, even in combination, the infrared and ultraviolet bands do not provide the capability of detecting a fire outdoors, especially under adverse atmospheric conditions such as fog, rain, or snow. The prior art optical fire sensors are short-range, wide-field-of-view devices (e.g., a range of from 16 meters to 25 meters and a field of view of approximately +/- 90 degrees). Even the best, prior art optical fire sensors are limited to a range of less than 70 meters.

As is known to those of skill in the art, the detection of fire outdoors requires different spectral band criteria than detection indoors, and the right combination of signal bands must be selected. For example, the solar radiation reaching the earth's surface creates a high background level across a large portion of the spectrum.

As is also known to those of skill in the art, optical fire sensors are essentially nonimaging and, therefore, do not provide any information about the location of a fire, even after the presence of a fire is detected. Needless to say, the location of a growing fire is crucial information in advanced fire detection where fire fighting resources need to be directed to the location of the fire while it is still small. Nonimaging sensors can only signal a zone alarm which carries no information as to the exact position of a fire.

Moreover, the smoke and other particles generated by a fire severely hamper any optical fire detection technique that relies on emissions in the infrared or visible or ultraviolet spectral bands. Smoke and airborne particulate matter both absorb and scatter signals in these spectral bands. Further, the presence of fog, rain or snow can completely absorb signals from fires on the shorter, optical wavelengths.

SUMMARY OF THE INVENTION

Thus, there is a particular need for a better fire detection system, especially for long range use outdoors. The above-discussed requirements of quick response rate, low false alarm rate, long range, wide angle, resistance to obscurants and ability to localize the position of a fire are satisfied by employing a thermal imaging scanning system that includes a radial scanning antenna that is mounted for rotation around an axis of angular scanning. Beneficial effects of the present invention, which are substantial improvements over the prior art, include a much longer range, a potential for full 360° angle coverage, a high sensitivity to fire, a very low false alarm rate, a superior ability to image through obscurants and an ability to resolve the position of a fire to within several meters, even in a large outdoor setting.

These, and other, aspects of the present invention will be better appreciated and understood when considered in conjunction with the following description and the accompanying drawings. It should be understood, however, that the following description, while indicating preferred embodiments of the present invention and numerous specific details thereof, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore nonlimiting, embodiments illustrated in the drawings accompanying and forming a part of this specification. It should be noted that the features illustrated in the drawings are not necessarily drawn to scale.

DESCRIPTION OF PREFERRED EMBODIMENTS

Figure 1:
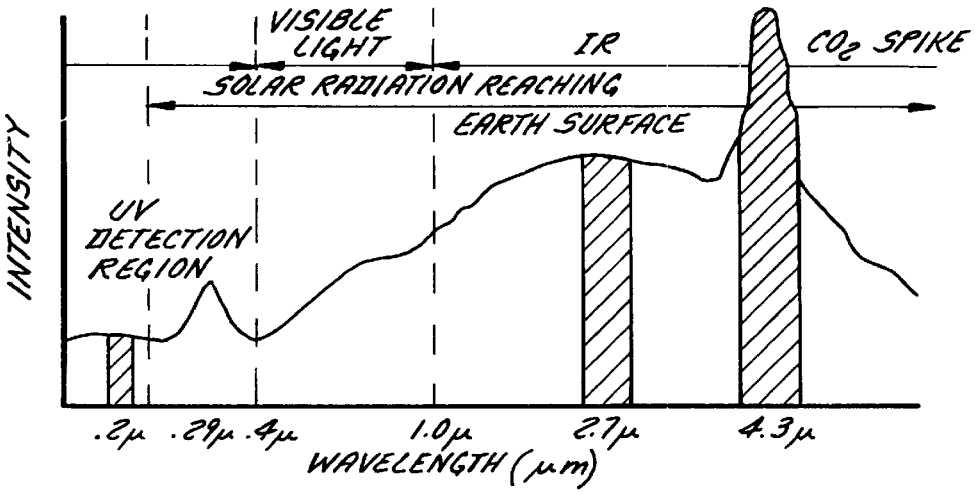
FIG. 1 PRIOR ART
FIG. 1 illustrates a typical hydrocarbon fire emission spectrum, appropriately labeled "PRIOR ART"

The present invention and the various features and advantageous details thereof are explained more fully with reference to the nonlimiting embodiments that are illustrated in the accompanying drawings and detailed in the following description. Descriptions of well known components and processing techniques are omitted so as to not unnecessarily obscure the present invention in detail. The entire contents of U.S. Pat. No. 5,572,228, which discloses radial scanning antennas, are hereby expressly incorporated by reference into the present application.

System Overview

Referring to the drawings, it can be seen that thermal imaging hardware can be remotely located for rotation about an axis of angular scanning. The invention can also utilize data processing methods that transform the signals received by the thermal imaging hardware so as to actuate interconnected hardware elements, such as, for example, alarms.

Apparatus and Methodology

Figure 4:
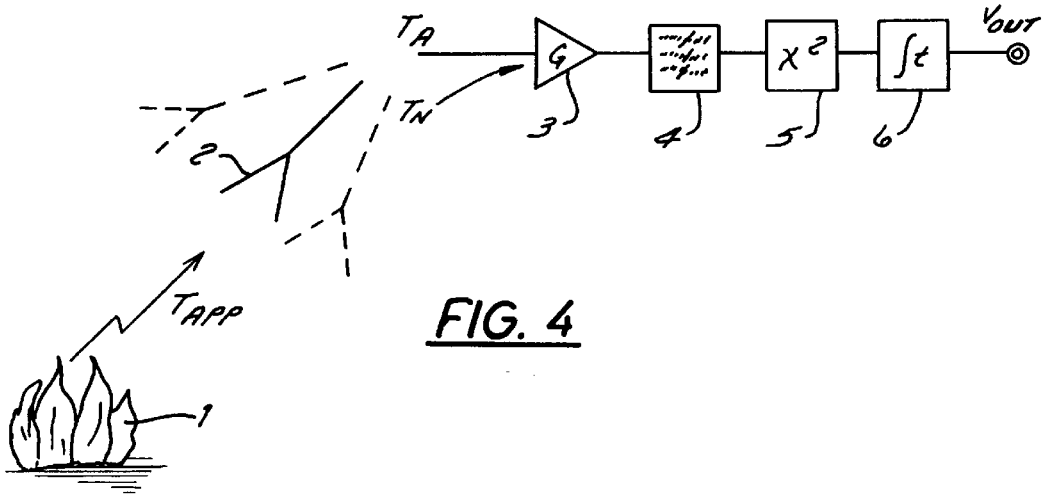
FIG. 4 illustrates a schematic view of the principle operations composing radiometric measurements, representing an embodiment of the present invention.

Referring to FIG. 4, in a simple embodiment of the invention electromagnetic emissions from a fire 1 are received by a scanning antenna 2. (Alternative physical positions for the scanning antenna 2 are indicated by dashed lines). In some contexts, the alternative positions include a full 360° rotation about an axis of rotation, but it is important to realize that the invention can provide 2-D scanning with a limited degree of rotation, such as, for example an arc of from approximately 30° to approximately 60°. The origin of such an arc can be located at the top of a tower or at the front of a vehicle, such as a car. The signal received by the scanning antenna 2 is then coupled to an amplifier 3. Background noise which is also received by and present in the amplifier is demarcated by $T_N$. The amplified signal is then coupled to a band pass filter 4 where the background noise $T_N$ is removed. The filtered signal is then coupled to a square law detector 5. The subsequently processed signal is then coupled to a time integrating element 6. The resultant signal is made available at an output terminal $V_{out}$.

Figure 5:
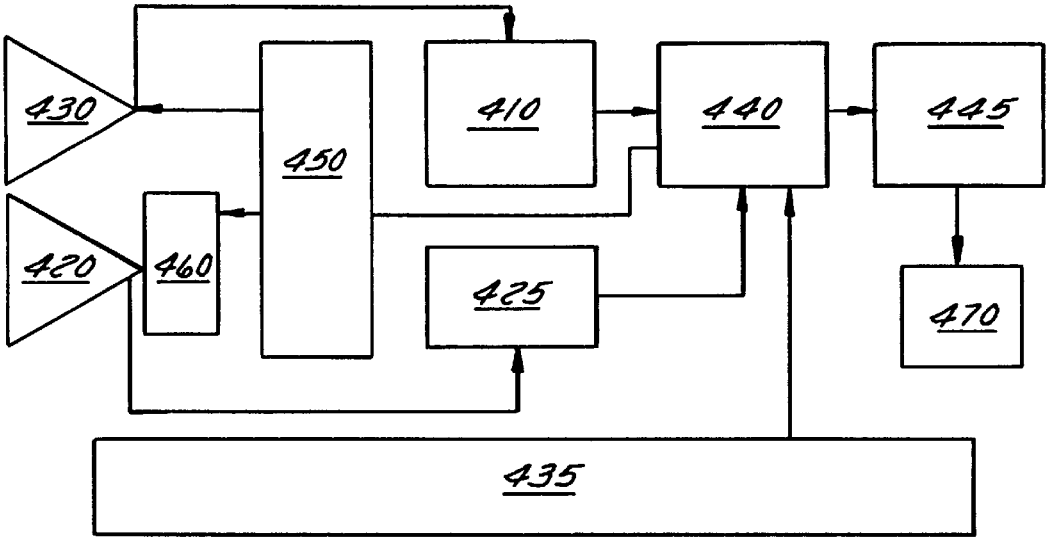
FIG. 5 illustrates a block schematic view of a combined sensor fire detection and warning system, representing an embodiment of the present invention.

Referring now to FIG. 5, another, more complicated, embodiment of the invention is depicted. The elements of this embodiment are labeled with different drawing numbering because the elements can be different. A combined thermal imaging-optical system can include a 94 GHz radiometer 410 combined with a triple band infrared optical sensor 420. A scanning antenna 430 provides spatial coverage in two directions. The antenna 430 rotates 360 degrees to provide full azimuth coverage and scans 45 degrees in elevation to provide wide area coverage. The system operates on 115 volts alternating current and can be equipped with a battery backup 435. A signal processor 440 detects the presence of a high temperature blackbody radiator based on emissions from the radiator. If the detected signal is greater than a predetermined threshold, then the system commands a scanning driver 450 to stop the scanning antenna 430 at the maximum signal strength. The optical sensor 420 is then focused on the location detected by the radiometer by a pitch driver 460. The optical sensor 420 has a combined sensitivity to i) flame flicker and ii) three narrow-band sections of the infrared spectrum most indicative of the presence of a flame. The information from sensor 420 is routed to an infrared sensor interface 425 (e.g. an $IR^3$ adapter) and then to processor 440. By using a lens on the optical sensor 420, a narrow field of view can provide the range required to verify the presence of fire that is initially detected by the radial scanning antenna. If both subsystems are triggered, processor 440 can activate alarm 470 via I/O 445.

Upon detection of a fire, the alarm 470 can be actuated. Two, or more, alarm indicators can be provided (e.g., an audible signal and an electrical signal). The audible signal can be generated by a varying pitch siren similar to what is used for industrial applications.

The electrical signal can be one or more of several types: contact closure (which would activate an audible alarm), discrete pulse, data word on a standard data bus, etc. The choices will be somewhat dictated by the number of sensors required to cover the standard area and the needs of the user. For example, a data word might be appropriate for sites that are very large and have a central guard office that interconnects several outposts via a land-line or a radio network.

Figure 2:
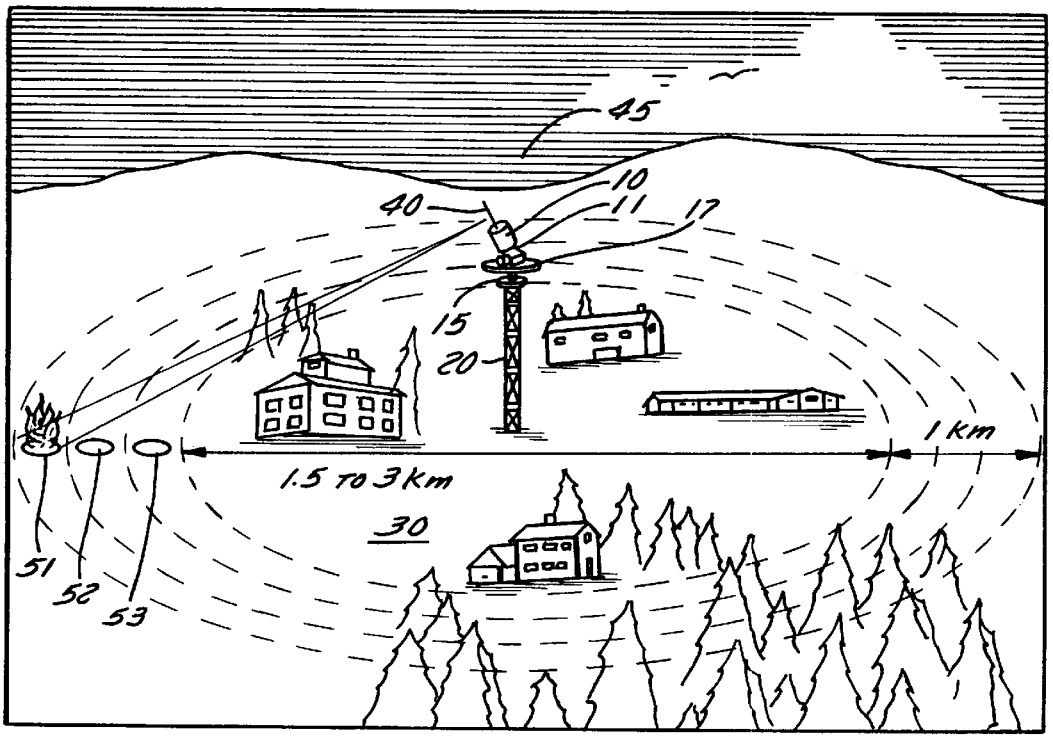
FIG. 2 illustrates a pictorial view of a thermal imaging system located in a residential area, representing an embodiment of the present invention.

Referring now to FIG. 2, another embodiment of the invention is depicted in context. The elements of this embodiment are labeled with different detail numerals because the elements can be different from the previously described elements. A radial scanning antenna 10 is rotatably mounted on turntable 15 that is mechanically connected to the top of a tower 20 which is located near the center of a residential area 30. The rotational position of the base of the radial scanning antenna 10 includes a spinning drum 11 whose axis of cylindrical symmetry defines a radial scanning axis 40. To better image the ground, the scanning antenna 10 is mounted on the tower 20 with the radial scanning axis 40 noncoincident with a normal 45 to the plane of the ground.

The normal 45 defines a center of angular scanning. The radial scanning antenna 10 provides fast radial scanning while the rotation of antenna 10 provides slow angular scanning. The combination of these two types of scanning achieves a large area of coverage together with a high resolution.

Combining a millimeter wavelength receiver of the type that is readily commercially available (e.g., from TRW Corporation) with the scanning antenna 10 results in a compact, millimeter wavelength radiometric sensor. This can be a passive listening device. Still referring to FIG. 2, the system utilizes two mechanically dynamic elements, each undergoing its own uniform rotation: the spinning drum 11 and the turntable 15. As will be discussed in more detail below, the spinning drum 11 provides the radial scan by coupling in radiation coming from an angle determined by a grating structure placed on the surface of the drum 11.

The turntable 15 provides the angular scan by rotating the scanning antenna 10. The output image from the system is formed by the combination of radial (i.e. longitudinal) and angular (i.e., azimuthal or circular) scanning. The radial scanning can be relatively fast, while the angular scanning can be much slower. While drum 11 spins continuously, the turntable 15 can rotate either continuously or in discrete steps. The turntable can be driven by an electric or hydraulic motor (i.e., a DC stepping motor), or any other suitable structure.

While in a single angular position, the scanning antenna 10 radially scans through and between, e.g., three illustrated positions 51, 52 and 53. As the turntable 15 rotates along the perimeter of the area to be protected, subsequent radial scanning will image corresponding positions but at different locations along the perimeter. In one embodiment, the scanning antenna 10 can be mounted to the turntable 15 with its scanning axis 40 at an angle to the normal 45 that is variable. This angle can be varied by means of a servo-mechanical device 17 such as gears and/or hydraulic actuators such as pistons, or any other suitable structure. By increasing the angle between the scanning axis 40 and a normal 45 to the ground, the diameter of the scanned perimeter can be reduced. In this way, resolution can be improved for positions that are close to the base of the tower 20. Further, reducing the diameter permits the signal to noise ratio to be maintained in the face of adverse weather conditions. This reduction of diameter also allows higher resolution of a detected hot-spot, or other object, that is within an original scan pattern, but relatively close to tower 20 (e.g., position 53). Conversely, where an improvement in resolution is not necessary, or in the case where weather conditions are advantageous, the angle between the scanning axis 40 and the normal 45 to the ground can be reduced so as to increase the radius of the perimeter being scanned.

Figure 3:
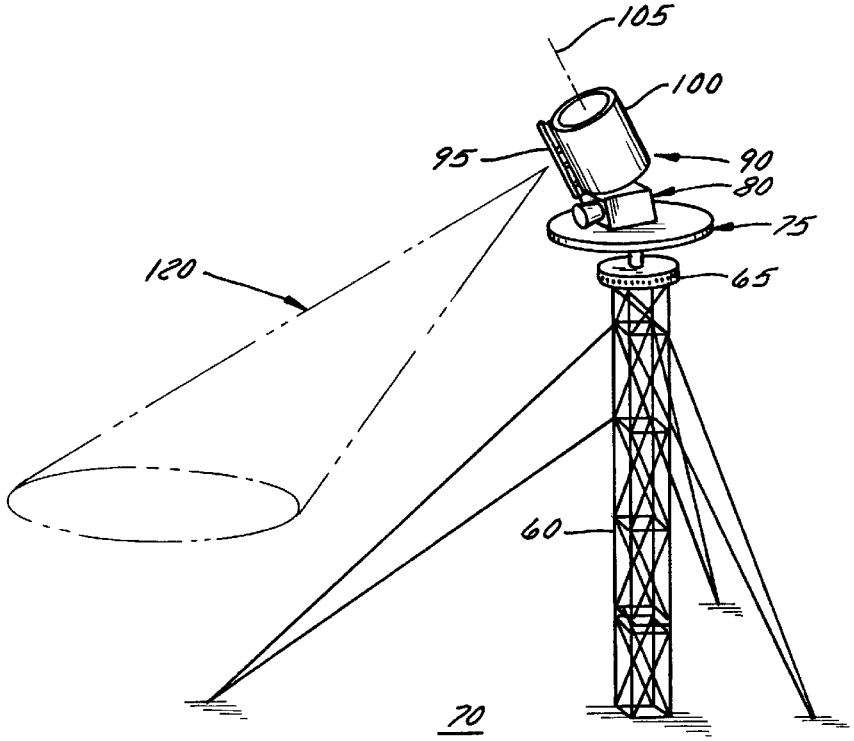
FIG. 3 illustrates a perspective view of a combined MMW and optical fire detection and warning system, representing an embodiment of the present invention.

Referring now to FIG. 3, another embodiment of the invention is shown. The elements of this embodiment are labeled with different detail numerals because the elements can be different from the previously described elements. This embodiment differs from the previously described embodiment (FIG. 2) in that it is a combined thermal imaging-optical system can be mounted on a mast 60 that extends some height above the surface of a storage area 70. Still referring to FIG. 3, the combined system can include a turntable 75, a optical sensor 80 and a millimeter wavelength radiometer 90 (i.e., a passive radial scanning antenna). The millimeter wavelength radiometer 90 can include a waveguide 95 and a spinning drum 100. The axis of the spinning drum 100 defines a radial scanning axis 105.

Again, the millimeter wavelength radiometer is scanned in two dimensions to get broad coverage. One dimension is provided along a radial direction by the spinning drum 100. The other dimension is provided along a circular path by the turntable 75. Thus, the bi-directional scanning is achieved by the coaction of the spinning drum 100 and turntable 75.

A relatively narrow beam 120 is used to provide the desired spatial resolution. When a signal that appears to be caused by a fire is detected, the angular (azimuthal) scan can be stopped and the optical sensor 80 can be focused on the target area. Confirmation of a fire by the optical sensor can be used to trigger an alarm 65. The alarm 65 can be audible, and the trigger signal can also be transmitted by fiber, copper wire or radio to a central monitor (not shown) to provide both general and specific location information. The number of combined thermal imaging-optical systems needed to provide complete coverage for a macrosystem will depend upon the size of the storage area and the distribution of the material being stored.

It can be appreciated that if the relatively narrow beam 120 were to be replaced with a wide beam, the spatial resolution in determining the fire location would be reduced. Further, it would be impossible to detect a small, developing fire, as the fire's "radar cross-section" would become a very small portion of the beam's footprint.

By combining two, or more, such scanning antennas located at two, or more, positions into an integrated system, a three dimensional thermal image can be formed using data from all, or at least two, of the antennas. Given proper placement of the antennas, and sufficient resolution, the volumetric extent of a hot spot could be determined rather than merely estimated. Further, the thermal contours of a hot spot could be imaged in 3-D, thereby providing information for an analysis of the hot spot based on both shape and temperature gradient.

Figure 6:
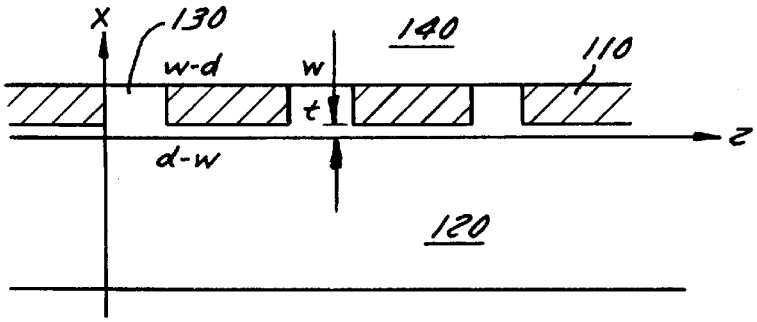
FIG. 6 illustrates a schematic view of evanescent wave coupling, representing an embodiment of the present invention.

Referring now to FIG. 6, the radial scanning antenna will be described in more detail. The embodiment of the antenna shown in FIG. 6 uses different detail numbering because its elements can be different from the previously described elements. An evanescent coupling scanning antenna can be assembled by providing by a metallic structure 110, which is placed in a region that is close to a dielectric waveguide 120, so that an evanescent wave propagates. Periodic perturbations close to the dielectric waveguide 120 cause electromagnetic waves, for example millimeter wavelength waves, to couple with (i.e., into or out-of) the waveguide 120.

The integral boundary equations for the unknown $E_y$ field can be solved in this geometry for a region filled with a medium 130, whose dielectric X, is $\in_m$. The contour integral will be replaced with a sum by using step functions with constant values over each segment of the contour. The Bessel function of the second kind and zeroth order, $N_o(.)$ can be used as the Green's function.

$$\psi(r, r_0) = -\frac{1}{4} N_0\left(\frac{2\pi}{\lambda} \varepsilon_m^{1/2} |r - r_0|\right), \tag{1}$$

where $r_o$ is the midpoint of each segment. The solution will yield the optimal geometrical distance t from the grating (which can be moving, for example, rotating) to the dielectric waveguide, the filling medium 130 dielectric permittivity $\in_m$ (starting from the air 140, $\in$=1) and the grating duty cycle ratio w-d/w required to maximize the coupling efficiency.

Figure 7:
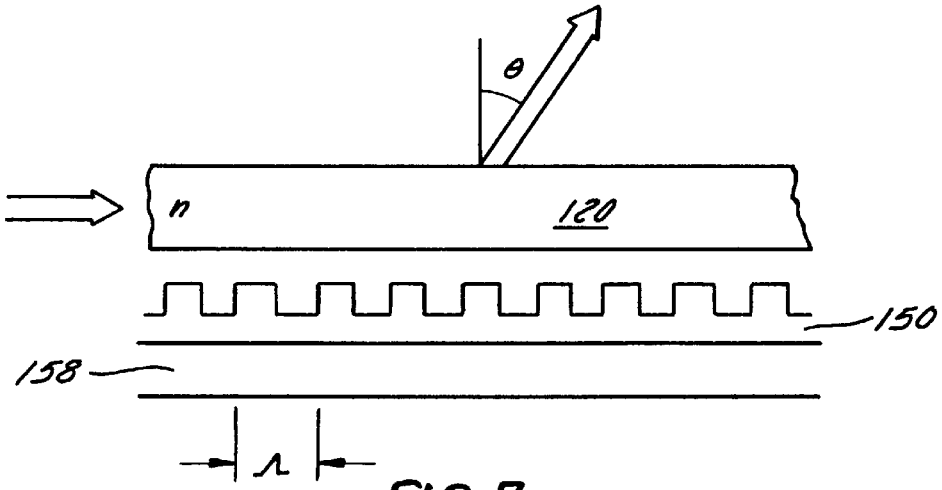
FIG. 7 illustrates a schematic view of an evanescent wave coupling out-of a dielectric waveguide, representing an embodiment of the present invention.

Referring now to FIG. 7, if a periodic metallic structure 150, with a period $\Lambda$, is brought into close proximity with the dielectric waveguide 120, coupling of electromagnetic waves, for example coupling of millimeter wavelength signals, occurs in a direction described by:

$$\sin\theta = \left(\frac{\lambda_g}{\lambda_o} - n\frac{\lambda_0}{\Lambda}\right), \quad (2)$$

where $\lambda_o$ and $\lambda_g$ are the wavelengths in free space and in a dielectric waveguide with a refractive index n, respectively.

As a result, electromagnetic energy, for example millimeter wavelength signals, will be evanescently coupled with the waveguide 120, in a controlled direction. In FIG. 7, coupling of waves out-of the dielectric waveguide 120 is shown. This direction can be changed rapidly, by changing the period Λ, to scan the antenna beam. In this transmitting mode, the outgoing millimeter wavelength signals will be preferentially evanescently coupled out-of the waveguide toward a particular direction.

A substrate 158 (FIG. 7) is provided for supporting the metal structure 150 and substrate 158 can be any material such as, for example, plastic, metal, glass or ceramic that is suitable for this purpose. Substrate 158, is preferably provided as a rotatable cylinder so that metal structure 150 can define a varying conductive grating pattern on the rotatable cylinder.

Figure 8:
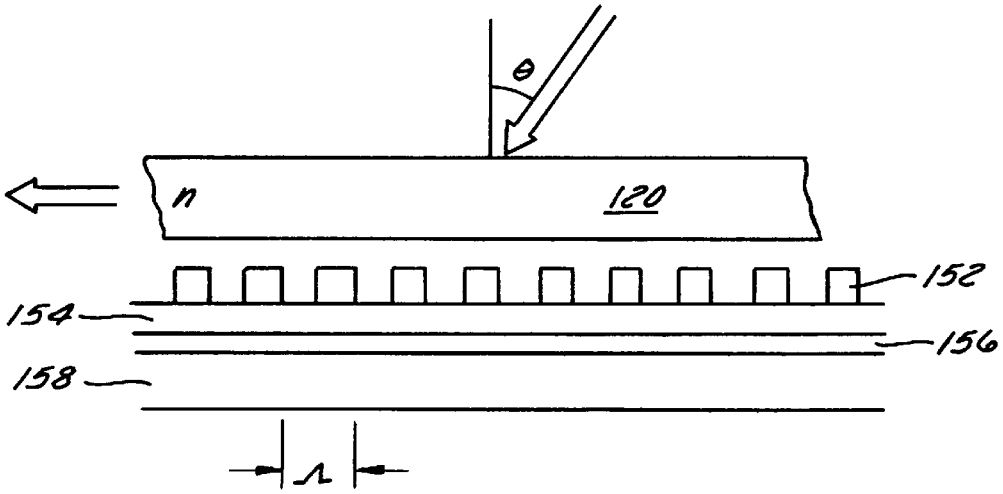
FIG. 8 illustrates a schematic view of an evanescent wave coupling into a dielectric waveguide, representing an embodiment of the present invention.

Referring now to FIG. 8, an alternative embodiment of the structure shown in FIG. 7 is depicted with the same structures identified by the same detail numbers. If a periodic metal grating 152, with a period Λ, is brought into close proximity with a dielectric waveguide 120, coupling of electromagnetic waves, for example coupling of millimeter wavelength signals, into the dielectric waveguide 120, also occurs. In the particular embodiment shown in FIG. 8, periodic metal grating 152 is formed on an insulator layer 154. Insulator layer 154 is formed on a metal shield layer 156. Similarly, metal shield layer 156 is formed on a substrate 158. Substrate 158 is preferably provided in the shape of a rotatable cylinder so that metal grating 152, insulator layer 154 and metal shield layer 156 all coaxial. In this receiving mode, the incoming millimeter wavelength signals will be preferentially evanescently coupled into the waveguide from a particular direction. The structure shown in FIG. 8 can be a passive radiometer.

Figure 9:
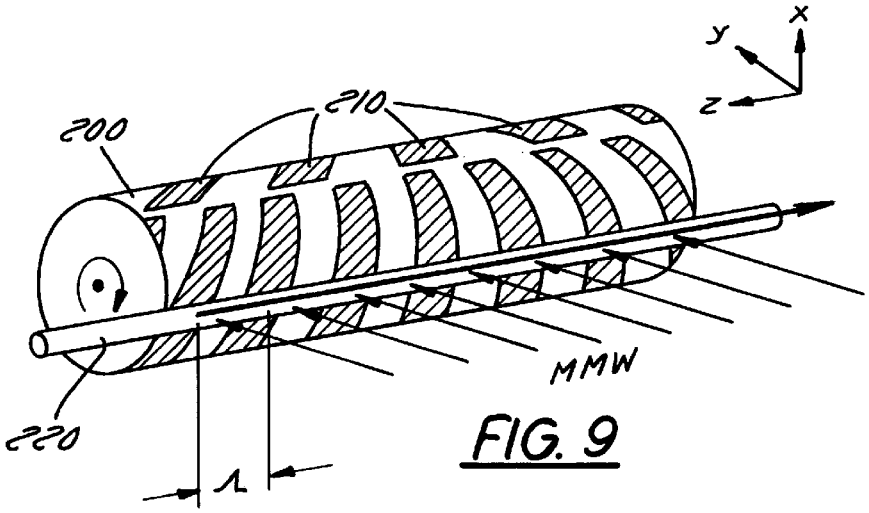
FIG. 9 illustrates a perspective view of a radial scanning antenna, representing an embodiment of the present invention.

Referring now to FIG. 9, an embodiment of the radial scanning antenna is depicted. The elements of this embodiment are labeled with different detail numerals because the elements can be different from the previously described elements. A rotating drum 200 is provided with a variable grating 210 of separated metal strips. The surface of rotating drum 200 is placed in close proximity to a dielectric waveguide 220. As rotating drum 220 spins, the period near waveguide 200 defined by the separated metal strips changes, thereby scanning in the Y-Z plane. In the embodiment depicted in FIG. 9, millimeter wavelength energy is illustrated as being received by the radial scanning antenna and directed into the dielectric waveguide 220.

Figure 10:
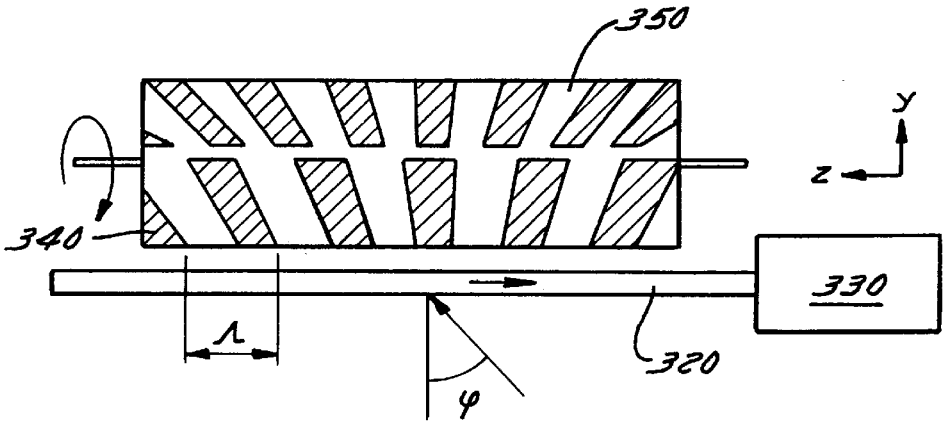
FIG. 10 illustrates an elevational view of a radial scanning antenna, representing an embodiment of the present invention.

Referring now to FIG. 10, another embodiment of the radial scanning antenna is depicted. The elements of this embodiment are identified with different detail numerals because the elements can be different from the previously described elements. A dielectric waveguide 320 is connected to receiver 330. A metal grating 340 defined by the separated metal strips on the outer surface of a spinning drum 350 defines the grating. It can be appreciated that the grating period varies along the circumference of the cylinder 350. The coupling angle ϕ is determined by the grating period, Λ in proximity to the dielectric waveguide 320. Again, radial scanning is in the Y-Z plane.

Thermal Imaging Theory

All objects at temperatures above absolute zero radiate energy in the form of electromagnetic waves. Objects not only radiate electromagnetic energy, they also absorb and reflect energy. A good absorber is also a good radiator (Kirchhoff's Law) and a perfect absorber is a perfect radiator. Such an absorber is called a blackbody. A blackbody absorbs all the radiation incident upon it, at all wavelengths, and the amount of radiation it emits is a function of only the temperature and the wavelength. The brightness of the radiation emitted by a blackbody is given by Planck's Radiation Law:

$$B=(2hv^3/c^2)/[\exp(hv/kT)-1], \quad (3)$$

where B=brightness (watts $m^{-2}$ $Hz^{-1}$ $rad^{-2}$); h=Planck's constant ($6.63\times10^{-34}$ Joule sec); v=frequency (Hz); c=velocity of light ($3\times10^8$ m/sec); k=Boltzmann's constant ($1.38\times10^{-23}$ Joule/deg K); and T=Temperature (deg K).

Fire acts as a blackbody radiator and therefore emits energy over a very broad range of frequencies. By using the sensitivity of a millimeter wavelength radiometer to do the primary detection, and the discrimination of an optical sensor (e.g. $IR^3$) to verify the presence of fire, warning of a fire in a large outdoor facility can be provided in less than a few minutes. The combined sensor fire detection and warning system works on the principle that fire will act as a blackbody radiator and will emit sufficient energy across a wide band of frequencies to be detected under almost all conditions. The selection of frequency (or frequencies) of operation for both subsystems must include the consideration of a number of factors including the amount of energy available, visibility through obscurant, cost, size, etc.

Figure 11:
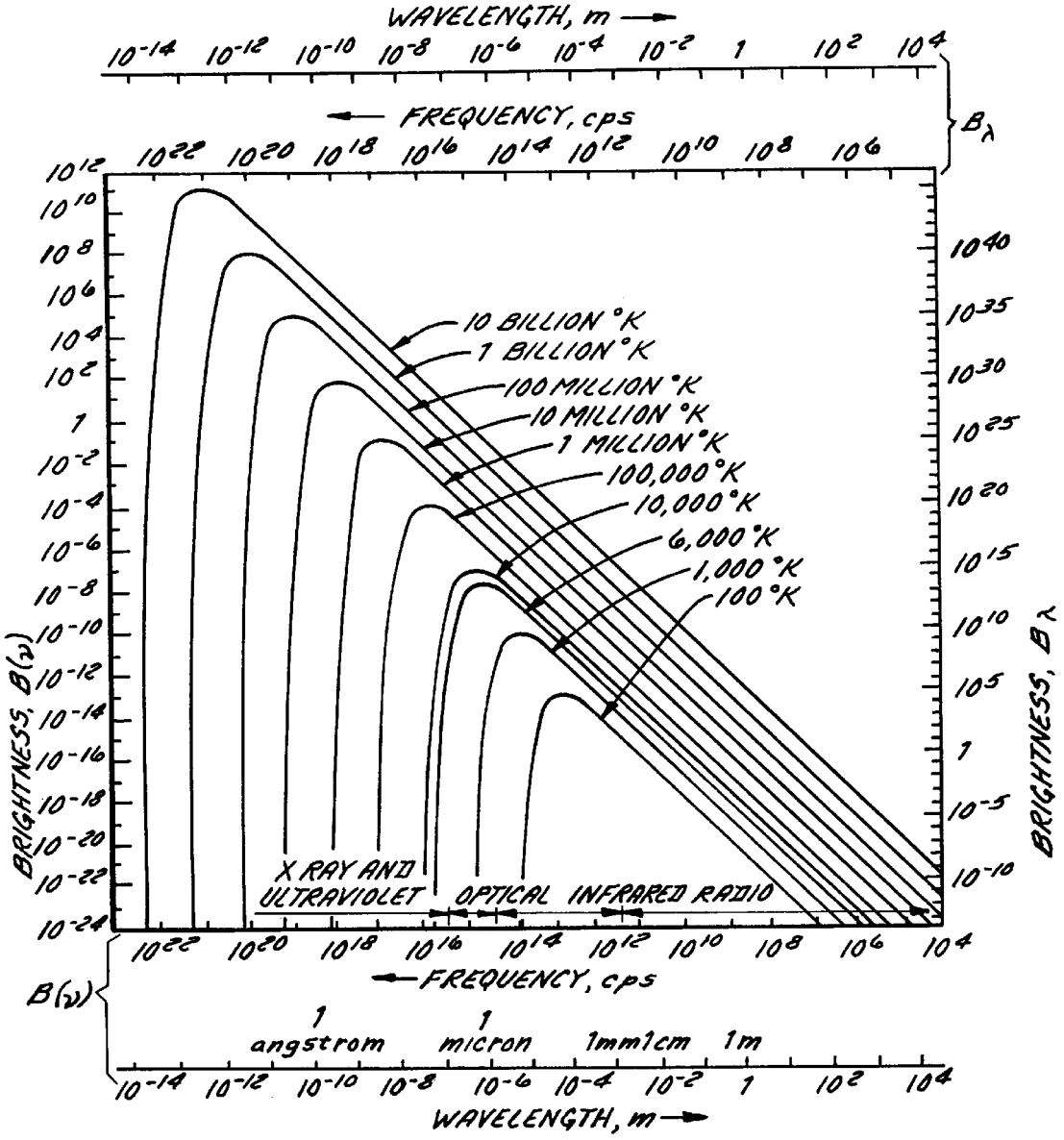
FIG. 11 PRIOR ART
FIG. 11 illustrates a set of Planck's Law radiation curves, appropriately labeled "PRIOR ART"

Referring now to FIG. 11, the energy available at different wavelengths can be estimated from a log-log scale plot of Planck's Law radiation curves. The infrared band contains considerable energy from blackbody radiators at all frequencies. For the special case of a discrete source (which an early fire might be considered) and the condition (true for millimeter wavelengths) hv<<kT, the Rayleigh-Jeans Law is a good approximation for the brightness such that:

$$S=2kT\Omega_s/\lambda^2, \quad (4)$$

where S=flux density (watts/$m^2$ Hz); Ω=solid angle subtended by the source ($rad^2$); and λ=wavelength (meters).

Figure 12:
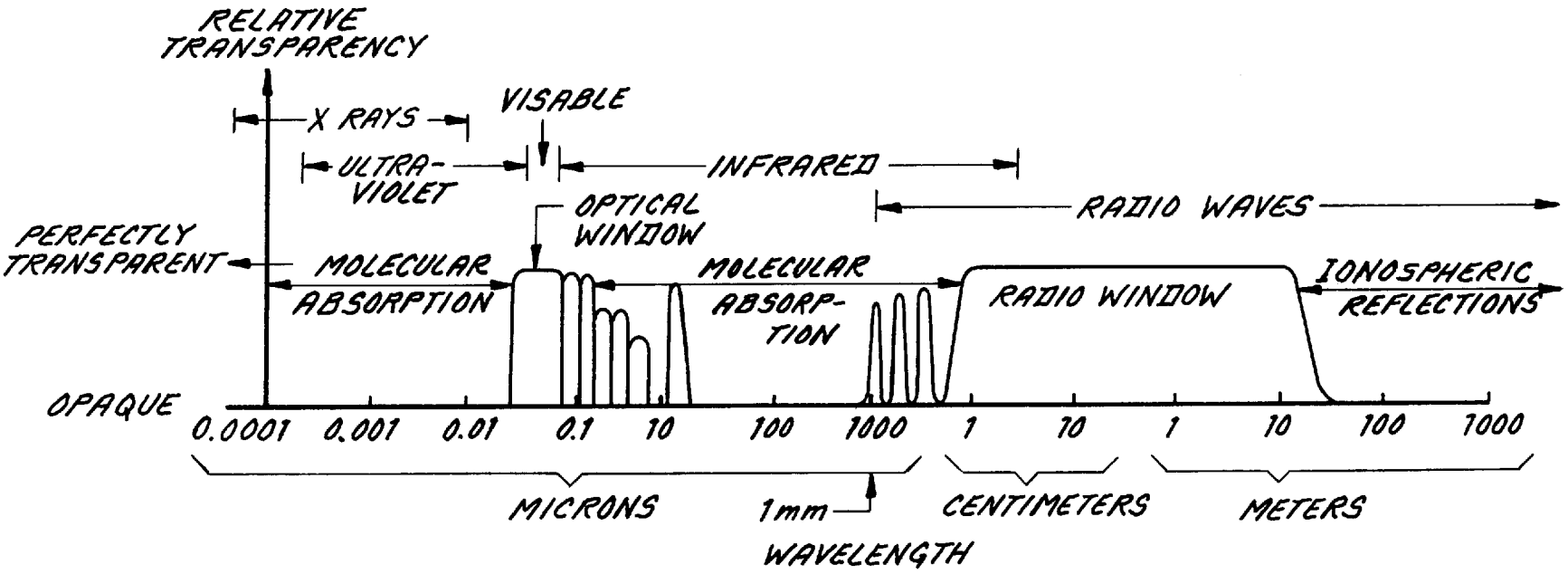
FIG. 12 PRIOR ART
FIG. 12 illustrates the relative transparency of the earth's atmosphere to electromagnetic energy, appropriately labeled "PRIOR ART"

Referring now to FIG. 12, it is clear from a plot of atmospheric transparency curves that some spectral regions are much easier to work in than others. Atmospheric conditions (fog, rain, snow, dust, etc.) have a great influence on much of the infrared band, but much less influence on the millimeter wavelength band.

Figure 13:
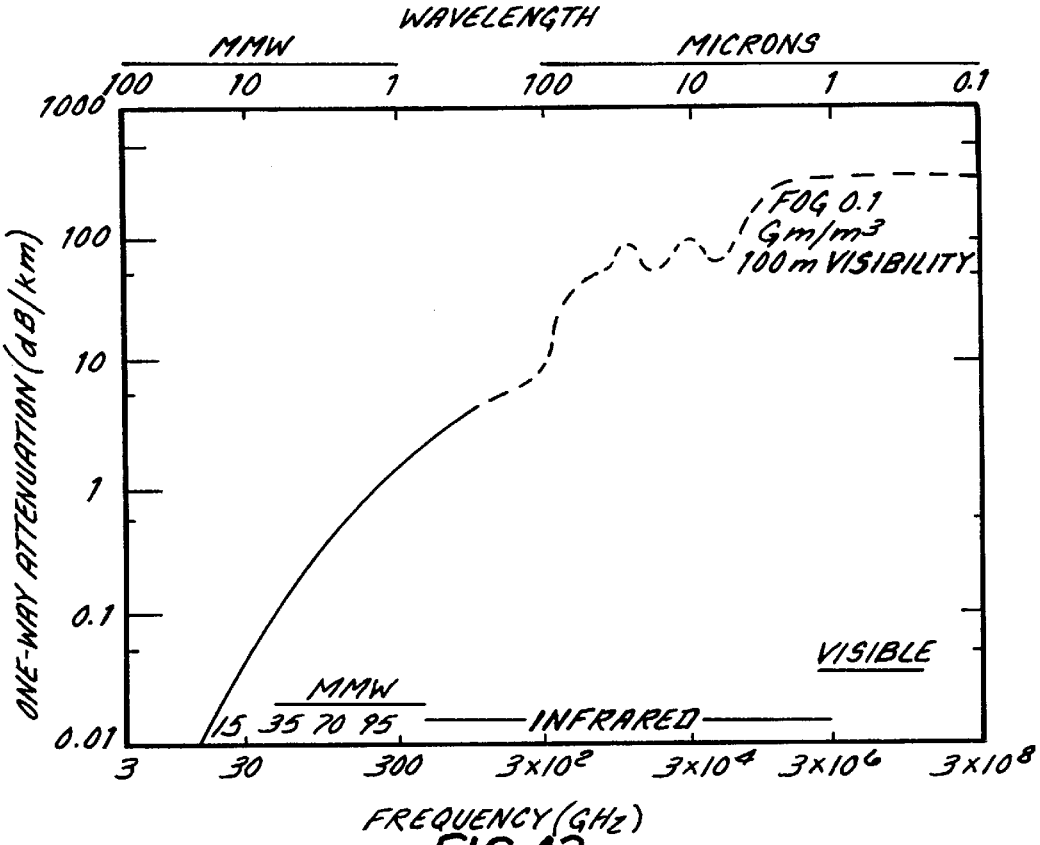
FIG. 13 PRIOR ART
FIG. 13 illustrates the attenuation of electromagnetic radiation in fog as a function of frequency, appropriately labeled "PRIOR ART"

As it follows from the standard Planck's black body radiation curves that the amount of energy (brightness) radiated in the millimeter wavelength band is several orders of magnitude lower than that in the infrared. However, referring now to FIG. 13, compared to the infrared, millimeter wavelength radiation suffers much less attenuation in fog (or in the presence of other adverse atmospheric conditions).

Since black body radiation is used as a starting point in any radiometric modeling, it is important to notice that the Rayleigh-Jeans approximation for Planck's formula $$B=2kT/\lambda^2=2v^2kT/c^2, \quad (5)$$

is valid in the millimeter wavelength region where B is the spectral brightness measured at the wavelength λ, or frequency λ, in units of watts/m$^2$ /Hz/steradian, T is the absolute temperature of the black body, k is Boltzman's constant; and c is the speed of light. This can be seen from the fact that for frequencies below 100 GHz the deviation from Planck's formula is less than 1%. Equation (4), when rewritten for brightness B, becomes equation (5).

Radiometers are classical passive systems used to measure the natural energy radiated from objects. Thermal emission, determined by temperature and emissivity, is generally the dominant contribution. Reflected and scattered radiation from other thermal emitters (the sun, ground, fire, etc.) may also be a significant part of the received energy. An upper bound of 1-micron wavelength is often used to mark the transition to photodetectors while a lower bound of 1-meter wavelength is used to mark the predominantly non-thermal background radiation at low frequencies.

The brightness given by equation (5) must be reduced by two factors. The first is related to polarization. Direct radiation from a thermal source is randomly polarized, therefore only one half of the signal can be received by an antenna. The second factor is related to the emissivity of sources. Thermodynamic equilibrium requires that absorption and emission be in balance. For the blackbody condition assumed in equation (5), they are equal. Natural thermal radiators have an emissivity $\in$ less than one. For these objects, the temperature T in equation (5) is replaced by $\in$T.

Figure 14:
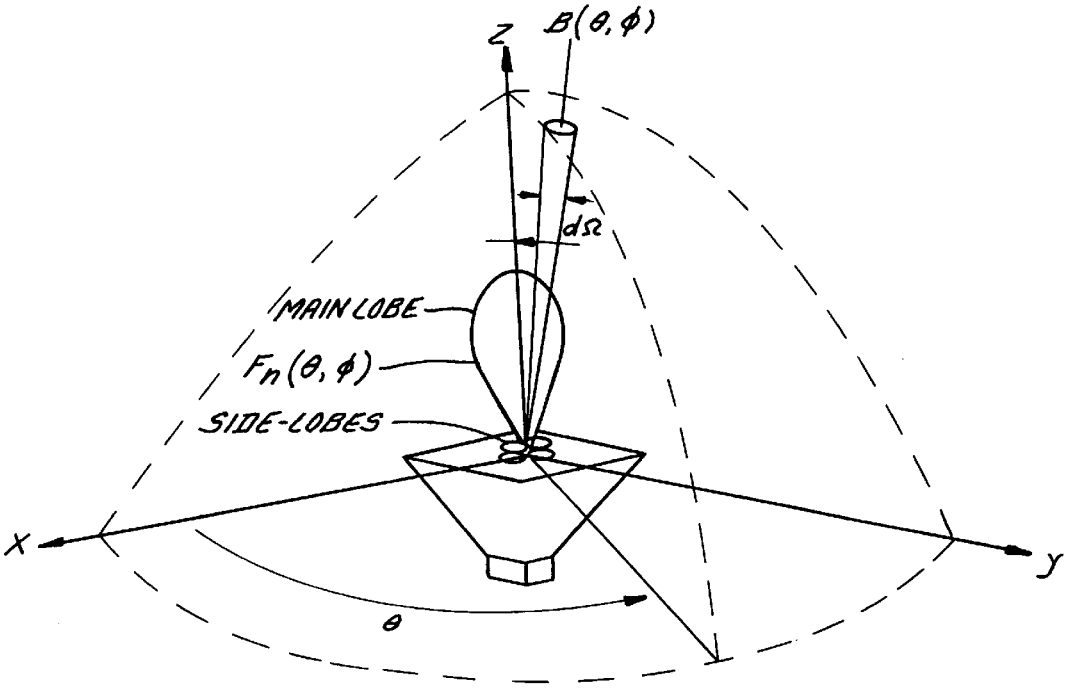
FIG. 14 illustrates a geometry of an antenna beam pattern and a cone of incident radiation intercepted by the antenna, representing an embodiment of the present invention.

The significance of the foregoing for millimeter wavelength sensing is that it establishes a linear relationship between the power P and the temperature T. Referring to FIG. 14, a general expression for the power received by a millimeter wavelength radiometer that has a receiving antenna aperture $A_r$ and a normalized antenna beam pattern $F_n(\theta,\phi)$ is, $$P = A_r \int_{\nu+\Delta\nu}^{\nu} d\nu \int_{4\pi}\int B(\theta,\phi)F_n(\theta,\phi)d\Omega \tag{6}$$

where B (θ,ϕ) is the normalized brightness.

It follows by substitution of equation (5) into equation (6) that $$P=kT\Delta\nu \tag{7}$$

for a small (Δν<<ν) spectral interval. Equation (7) suggests that a receiving antenna measures the temperature of the radiation incident upon it (apparent temperature) in the same way a resistor connected to the same input terminal measures the thermal noise.

The received power per Hertz, W, for an antenna of effective area A, is given by:

$$W = \left(\frac{1}{2}\right)\int\int_{\Omega} A(\theta,\phi)B(\theta,\phi)d\Omega \tag{8}$$

For radiometry, antenna temperature $T_A$ replaces the received power W as the measure of signal strength and is defined as the temperature of a matched resistor with noise power output equal to the received power per Hertz:

$$W=kT_A \tag{9}$$

For a non-black body radiating toward the antenna, the temperature T becomes an apparent temperature $T_{App}$ that can be determined from Equation (7) by measuring the power received by the antenna. Integrating the measured apparent temperature distribution $T_{App}(\theta,\phi)$ over the solid angle of the antenna beam pattern, yields an antenna radiometric temperature $T_A$ according to the relationship $$T_A = \frac{A_r}{\lambda^2}\int_{4\pi}\int T_{App}(\theta,\phi)F_n(\theta,\phi)d\Omega \tag{10}$$

where $A_r$ is the receiving antenna aperture; λ is the wavelength of operation; and $F_n(\theta,\phi)$ is the normalized antenna beam pattern.

For a discrete source, such as a developing fire, the detected temperature is $$T_A = \frac{\Omega_s}{\Omega_p}T_F \tag{11}$$

where $\Omega_s$ and $\Omega_p$ are the solid angles subtended, respectively, by the fire and by the antenna, and $T_F$ is the apparent fire temperature. Since the discrete source is measured against the background, equation (11) relates the detected temperature contrast to the ratio of the area of the fire to the antenna beam footprint, which reinforces the need for a narrow-beam scanning antenna.

The apparent temperature or brightness, if other sources of radiation and absorption are neglected, is detected by the scanning antenna and results in a power output at the antenna terminal with an equivalent temperature $T_A$, see equation (10). Referring again to FIG. 4, the receiver noise having an equivalent temperature $T_N$ is added to the input signal $T_A$ and then amplified by the amplifier 3 with a gain G. After passing the band pass filter 4 with a bandwidth B, the signal is detected by the square law detector 5 which, over the integration time τ, provides an output voltage that is proportional to the input power (temperature).

The sensitivity, ΔT (i.e. the temperature contrast), that can be measured by the radiometer can be calculated as $$\Delta T=(T_A+T_N)/(\sqrt{B\cdot\tau}) \tag{12}$$

Achieving a good temperature sensitivity (1° K or less) largely depends on the amount of receiver noise $T_N$. The millimeter wavelength receiver, described below, provides a sufficiently low noise figure. Also, since the radiometer measures the incident radiation (temperature) against the background of the receiver noise, some additional switching operation is needed to subtract this noise. (This noise has a constant mean value). The scanning antenna, described above, eliminates the need for additional switching as it generates a differential temperature mapping.

The received energy from the radial scanning antenna can be coupled directly to a millimeter integrated circuit (MMIC) receiver. A typical MMIC receiver sensitivity is 0.4° K radiometer can cover a 300 meter by 300 meter site.

Such a receiver is readily commercially available from TRW corporation in the form of a W-band direct detection MMIC. It is a high-gain, wide bandwidth, low-noise amplifier. The amplifier has an integrated Schottky barrier diode detector that is fabricated using a 0.1 mm InGaAs HMET production process. The receiver measures 7 mm by 2 mm and has a gain of >20 dB over a bandwidth of 10 GHz with a noise figure of 5.5 dB. The average temperature sensitivity of 0.4° K with 10 millisecond integration time is achieved with the chips assembled on modules and with an antenna attached to the input.

To detect the minimum contrast, ΔT, between two beam positions, the input signal-to-noise ratio S/N must be maximized $$S/N=\Delta T/(T_A+T_N). \quad (13)$$

where $T_N$=receiver noise level (deg K).

It is clear from equation (13) that the contribution from $T_N$ must be minimized. Radiometers in the millimeter wavelength band can be designed and fabricated with broad bandwidths and low noise front ends, as discussed above. The advantage of such parameters is the ability to detect small changes in temperature which provides margin for other system design parameters such as beamfilling, scanning rate, dwell time, antenna efficiency, etc.

Fire, at its early stages, can be considered a discrete source. Therefore, referring to the beamfilling factor suggested by Equation (11), and assuming a ΔT of 1° K and a source temperature of 1500° K, the minimal beamfilling factor is 0.0007. This implies an antenna beamwidth of 2.5 degrees or smaller. This is based on the assumption that a 360 degree azimuth scan and a 45 degree elevation scan will give the coverage needed. With a 2.5 degree pencil beam, 144 beam positions in azimuth, and 18 elevation beam positions for each azimuth position, will be needed. To be conservative, from a systems implementation perspective, assuming a dwell time of 100 msec for each beam position allows adequate integration time to detect the 1° K change in signal. This, in turn, indicates that a complete 360 degree scan of the site will take on the order of 4.5 minutes, not an unreasonable length of time. Alternatively, a much smaller beam with a shorter dwell time can be used while maintaining the same scan period.

As previously discussed, the operational concept is to use the millimeter wavelength radiometer for first detection of a possible fire. Unlike optical sensing, which relies upon radiation emitted by a luminous flame, the millimeter wavelength downlooking sensor will detect radiation originating from solids heated or burning in the fire (e.g., soil, woods, structural materials, etc.) and, from particulate present in the flame.

Figure 15:
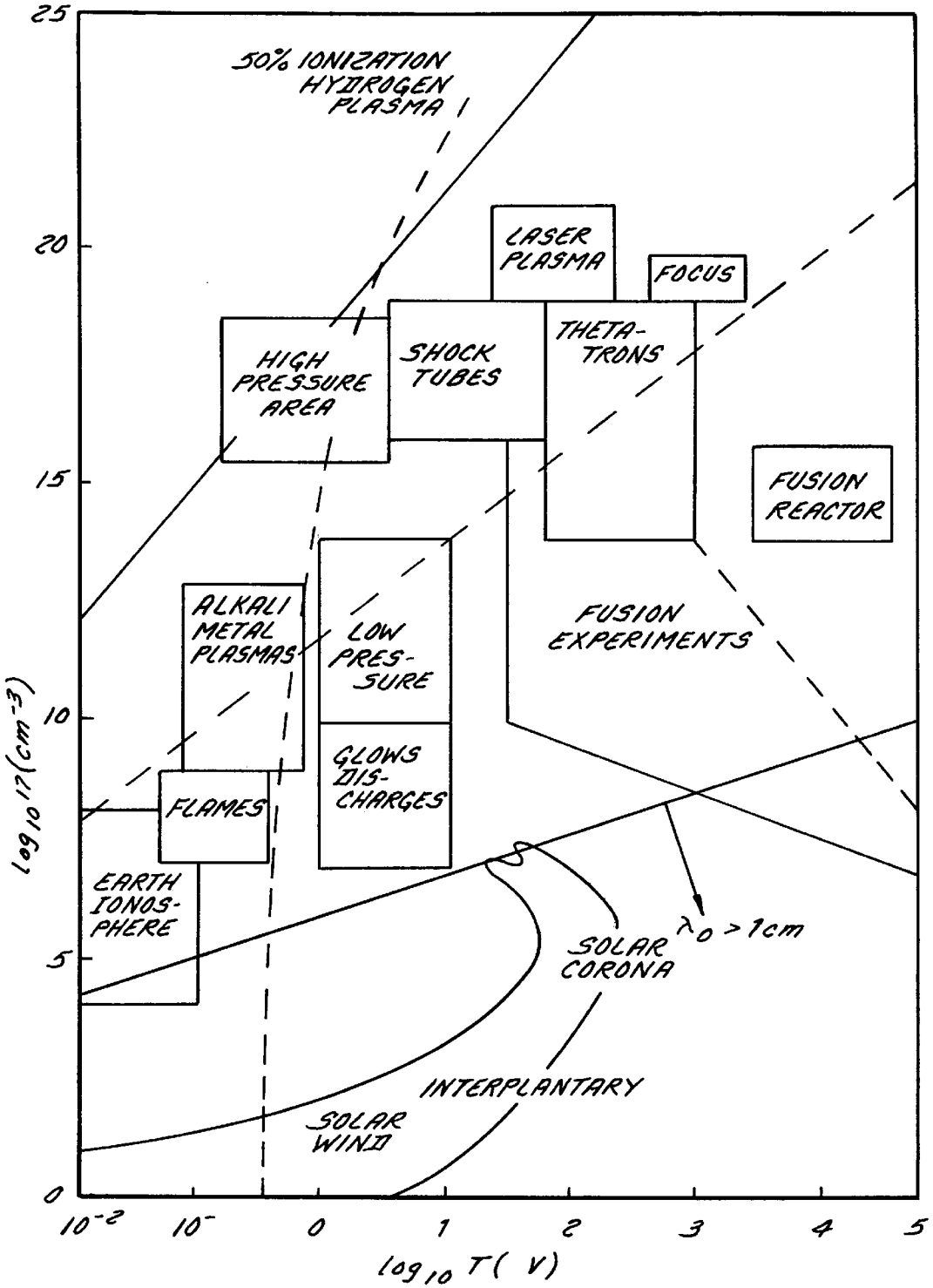
FIG. 15 PRIOR ART
FIG. 15 illustrates free charge concentration for some typical plasmas, appropriately labeled "PRIOR ART"

Although the flame can be considered as a plasma, it is too "cold" a plasma to generate sufficient density of free charges to affect millimeter wavelength adsorption. For the absorption to be significant, plasma density must be higher than $10^{17}$ $cm^{-3}$. Referring to FIG. 15, the concentration of free charges in the flames is quite low. FIG. 15 also depicts baselines for the collision mean free path $\lambda_D$.

As an example of a material that is heated by the fire, consider a rough surface soil underlying the burning dry vegetation (e.g., bushes, grass, etc.). In the Rayleigh-Jeans approximation discussed above, the source function J(x,y) is proportional to the physical temperature T(x,y) of the medium at the point (x,y)

$$J(x, y) = \frac{2k}{\lambda^2} T(x, y)\Delta v \quad (14)$$

Figure 16:
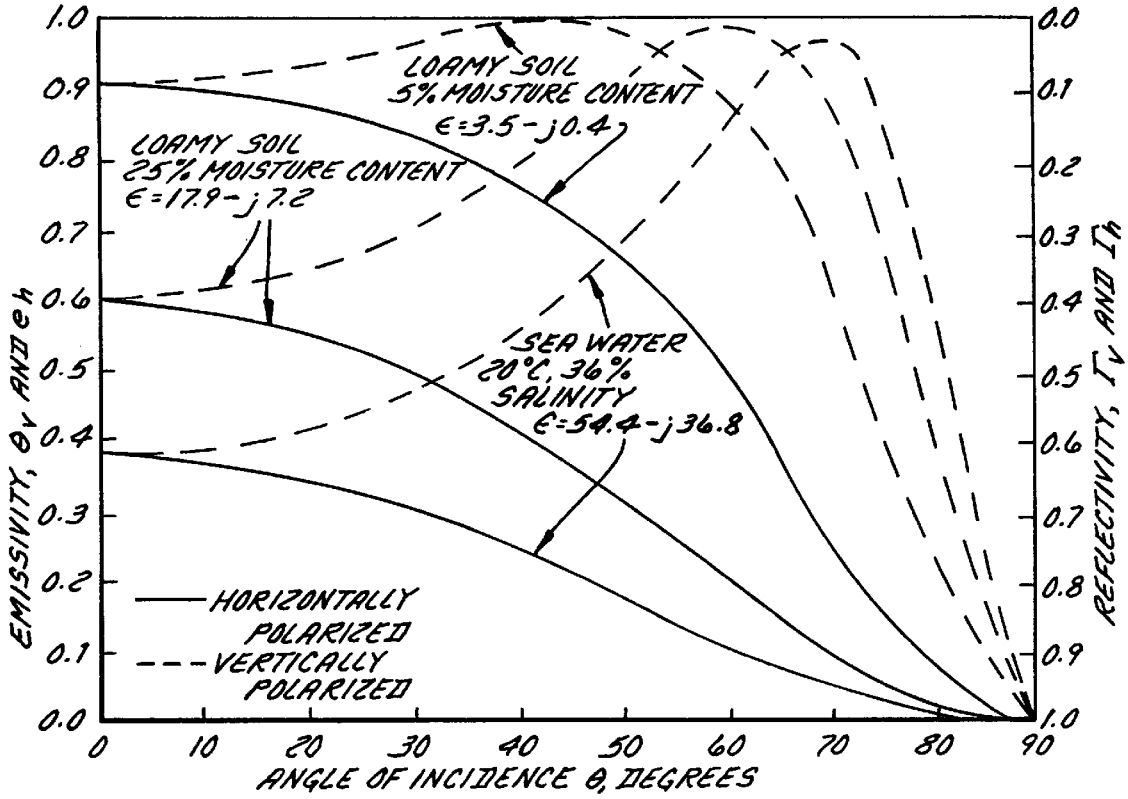
FIG. 16 PRIOR ART
FIG. 16 illustrates calculated millimeter wavelength emissivity and reflectivity as a function of emitting (or incidence) angle, appropriately labeled "PRIOR ART"

This source function accounts for thermal emission and, under conditions of local thermodynamic equilibrium, is directly proportional to the absorption of the medium and inversely proportional to the material's reflectivity. Referring to FIG. 16, emissivity and reflectivity for both horizontal (h) and vertical (v) polarizations for soil with different moisture content is depicted. The values of the complex dielectric constant (e) used in the calculations are shown next the curves in FIG. 16. Sea water characteristics are shown for comparison.

Dry soil approximates a black body at small angles of incidence, and for large incidence angles (between 50 and 70 degrees), all surfaces have emissivity close to 1 for the vertical polarization (a circumstance related to the Brewster angle condition).

When a fire occurs, the physical temperature of the burning area rises, generating an apparent temperature contrast, $\Delta T_{App}$, perceived by the millimeter wavelength sensor $$\Delta T_{App} = \Delta T \frac{S_F}{S_B} E \quad (15)$$

where ΔT is the fire-to-background temperature contrast, $S_F$, is the fire area, projected normal to the line of sight, $S_B$ is the background area normal to the line of sight, and E is the antenna directivity.

Figure 17:
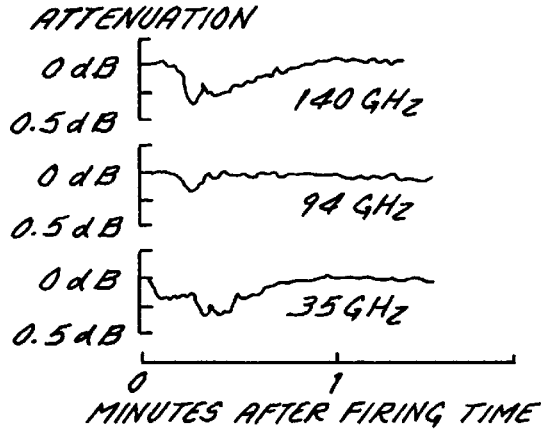
FIG. 17 illustrates atmospheric attenuation measured at three different frequencies as it evolves following a sudden over-pressure caused by a chemical reaction, appropriately labeled "PRIOR ART".

Dust, smoke and soot particles are both a source of thermal emission to be detected by the millimeter wavelength sensor and a scattering medium diminishing the see-through capability of the active sensor. Referring to FIG. 17, total attenuation by particulates of explosives of three frequencies are depicted.

Similar data has been previously obtained for other smokes, including hexachloroethane, white and red phosphorus, oil fog, and plasticized phosphorous. It can be appreciated that dust, smoke and soot particles will not prevent an millimeter wavelength sensor from operation.

Hayes performed some calculations for the attenuation by sand and clay particles of millimeter wavelengths. His equation for the attenuation coefficient can take the form $$\alpha=144\pi^5 a^6 N(\in-1)^2/[3(\in+1)^2], \quad (16)$$

where N is the concentration of particles, and a is the particle diameter.

The total emissivity e of a particulate can be estimated in a way similar to that in calculating the optical emissivity of a cloud of soot, $$e = \frac{\frac{2\pi}{C_1}\int_{\lambda}^{\lambda+\Delta\lambda} f(\lambda)\lambda^5 \exp[C_2/(\lambda T)]d\lambda}{C_0 T^4} \quad (17)$$

where $C_0$, $C_1$ and $C_2$ are known constants. The function f(λ) can be taken from an experimental study in the optical band that specifies the spectral emissivity over a path of length l in the flame as:

$$f(\lambda)=1-\exp(-N\in l/\lambda_\beta) \quad (18)$$

where β is a constant that must be determined from measurements performed at millimeter wavelength.

Example

A specific embodiment of the present invention will now be further described by the following, nonlimiting example which will serve to illustrate various features of significance. The example is intended merely to facilitate an understanding of ways in which the present invention may be practiced and to further enable those of skill in the art to practice the present invention. Accordingly, the example should not be construed as limiting the scope of the present invention.

The example is directed to a combined system including millimeter wavelength radiometric sensors augmented by an optical sensor. The optical sensor is the Selectrex, Inc. SHARPEYE™ $IR^3$ Flame Detector. The characteristics of this device are shown in Table 1.

TABLE 1

SHARPEYE ™ Characteristics

| Parameter | Performance |
|---|---|
| Detection range | Up to 200 feet (selectable) |
| Field of View | 90° cone |
| Non-scanning response time (standard fire) | ~2 seconds |

The millimeter wavelength radiometer sensor selected combines 94 GHz radiometer with a scanning antenna that is commercially available from WaveBand Corporation of Torrance, Calif. Characteristics of the resulting millimeter wavelength radiometer are shown in Table 2.

TABLE 2

MMW Radiometer Sensor Characteristics

| Parameter | Performance |
|---|---|
| Detection range | 1 km, minimum |
| Field of View | 360° by 45° |
| Non-scanning response time (standard fire) | ≈100 msec |

Practical Applications of the Invention

A practical application of the present invention which has value within the technological arts is fire detection at a location such as an urban/wildland interface where valuable properties may border with parched brush. This type of interface is typical for many communities throughout the west and southwest United States. Another location where the invention is useful for the purpose of fire detection is at industrial facilities such as, for example, open storage, hazardous material dumps, oil refineries and chemical plants. In either location, the invention can provide a wide area of coverage via long range and a 360° field of view.

Another practical application of the invention is fire detection where a need exits to provide high resolution positional information on the location of a fire. Despite wavelengths that are much longer (three orders of magnitude) than optical wavelengths, millimeter wavelengths still deliver a resolution that is adequate to exactly locate the source of fire. (The resolution degrades when one moves to the microwave region.) For example, at a distance of one kilometer, a moderate directivity scanning antenna would have a resolution of approximately 15 meters. This permits a directed fire suppression response by emergency personnel.

Another practical application of the invention is in areas where false alarms are often generated by other systems. Millimeter wavelength detection is immune to false alarms resulting from various sources of light. Metal surfaces that reflect light look "cold" to the millimeter wavelength radiometer because the emissivity is very low (conversely, such metal surfaces have high reflectivity). The invention has the ability to reject as false most alarms caused by high-intensity radiation sources other than fire, such as sun glare or artificial lights.

Further, another practical application of the present invention is fire detection under adverse weather conditions such as fog, rain, snow or hail. Millimeter wavelengths (and microwaves to an even larger extent) provide sufficient penetration under adverse weather conditions to detect a source of fire up to one kilometer away. This is in contrast to optical fire sensors, where the intensity balance between the infrared/UV spectral lines that the sensor relies upon vary in the course of atmospheric propagation.

Furthermore, another practical application of the present invention is fire detection in conjunction with rescue operations that may call for a sensor capable of seeing through flame and smoke that contains soot particles. There are virtually innumerable uses for the present invention described herein, all of which need not be detailed here.

Although the best mode contemplated by the inventors of carrying out the present invention is disclosed above, practice of the present invention is not limited thereto. All the disclosed features and elements of all the disclosed embodiments can be combined with, or substituted for the disclosed features and elements of every other disclosed embodiment, except where such features or elements are mutually exclusive. It will be manifest that various additions, modifications and rearrangements of the features of the present invention may be made without deviating from the spirit and scope of the underlying inventive concept. Accordingly, it will be appreciated by those skilled in the art that, within the scope of the appended claims, the invention may be practiced otherwise than as specifically described herein. For example, the data analysis could be enhanced by providing additional or alternative signal transformation methods. Further, although the thermal imaging system described herein is a physically separate module, it will be manifest that the thermal imaging system may be integrated into the apparatus with which it is associated.

It is intended that the appended claims cover all such additions, modifications and rearrangements. Expedient embodiments of the present invention are differentiated by the appended subclaims.

What is claimed is:

1. An apparatus for detecting a fire, the apparatus comprising:

a rotatable radial scanning antenna, said rotatable radial scanning antenna defining a rotatable plane of radial scanning;

a turntable mechanically connected to said rotatable radial scanning antenna, said turntable defining a vertical axis of angular scanning that is coincident said rotatable plane of radial scanning; and wherein said rotatable radial scanning antenna includes a spinning drum that defines an axis of radial scanning that is coincident said rotatable plane of radial scanning such that said axis of radial scanning and said axis of angular scanning define an angle of elevation within said rotatable plane of radial scanning.

2. The apparatus of claim 1, wherein said axis of radial scanning is noncoaxial with said axis of angular scanning.

3. The apparatus of claim 1, wherein said turntable includes a structure for varying said angle of elevation.

4. The apparatus of claim 1, further comprising an optical sensor, wherein said optical sensor is mounted generally adjacent to said rotatable scanning antenna and is oriented such that said optical sensor generally focuses on the fire when said rotatable scanning antenna detects the fire.

5. A method for fire detection which comprises utilizing the apparatus of claim 1.

6. A method for detecting a fire, the method comprising the steps of:

providing a radial scanning antenna; and then receiving a signal having a wavelength within the millimeter wavelength (MMW) range through said radial scanning antenna;

radially scanning said radial scanning antenna by rotating at least a portion of the scanning antenna about an axis of radial scanning; and angularly scanning said radial scanning antenna by rotating the radial scanning antenna about a vertical axis of angular scanning.

7. The method of claim 6, further comprising the steps of:

repeating the steps of receiving and radially scanning prior to repeating the step of angularly scanning; and compiling an image based on signal amplitude and radial and angular scanning angles.

8. The method of claim 7, wherein said radial scanning step occurs about an axis of radial scanning and said step of angularly scanning occurs about an axis of angular scanning such that said axis of radial scanning and said axis of angular scanning define an angle of elevation, and, further comprising changing said angle of elevation to alter the resolution of the image.

9. The method of claim 6, wherein the step of angularly scanning is continuous.

10. A method of detecting a fire in a predetermined area, the method comprising the steps of:

radially scanning the area with a MMW scanning device, said radially scanning step comprising rotating at least a portion of the scanning device about a radial scanning axis;

angularly scanning the area with the scanning device to scan a perimeter of the area, said angularly scanning step comprising rotating the scanning device about an angular scanning axis;

stopping said angularly scanning step when the scanning device detects the fire at a general location;

focusing an optical sensor on the general location in response to said stopping step; and using the optical sensor to (1) confirm the presence of the fire, and (2) if the fire is present, determine a particular location of the fire, wherein the particular location is disposed within the general location.

11. The fire detecting method of claim 10, wherein said radially scanning step and said angularly scanning step occur generally simultaneously.

12. The fire detecting method of claim 10, wherein the scanning device is disposed at an elevated position relative to the ground, and the radial scanning axis is not collinear with the angular scanning axis.

13. The fire detecting method of claim 12, including the step of controlling an elevation angle defined by the radial scanning axis and the angular scanning axis.

14. The fire detecting method of claim 13, further comprising the step of generating an image in response to a combination of (1) said radial scanning step, and (2) said angular scanning step, wherein the image has an associated resolution.

15. The fire detecting method of claim 14, further comprising the step of increasing the elevation angle to reduce a diameter of the perimeter of the area and thus improve the resolution of the image.

16. The fire detecting method of claim 13, wherein said controlling step is performed by using a servo-mechanical device.

17. The fire detecting method of claim 10, further comprising the steps of:

generating a warning signal in response to said using step when said using step confirms that the fire is present; and triggering an alarm in response to said warning signal.

18. The fire detecting method of claim 10, wherein said angularly scanning step is performed by (1) mounting the scanning device on a turntable, and (2) rotating the turntable.

19. The fire detecting method of claim 18, wherein said angularly scanning step is performed at a slower speed than said radially scanning step.

20. The fire detecting method of claim 10, wherein said angularly scanning step is performed over a range approximately equal to 360°.

* * * * *